United States Patent [19]

Chang

[11] 4,375,296

[45] Mar. 1, 1983

[54] CLIPBOARD

[76] Inventor: Shih H. Chang, No. 2-12, Chang Lu Rd., Chang Hwa City, Taiwan

[21] Appl. No.: 288,726

[22] Filed: Jul. 31, 1981

[30] Foreign Application Priority Data

Apr. 2, 1981 [TW] Taiwan ..... 7021791

[51] Int. Cl.[3] ..... B42D 17/00

[52] U.S. Cl. ..... 281/45; 211/45; 24/67.3; 428/78; 428/137

[58] Field of Search ..... 428/77-78, 428/99, 100, 131, 137; 211/45; 248/451-453; 24/67.3; 281/45; 40/16.6, 11 R, 11 A, 13, 23 R

*Primary Examiner*—George F. Lesmes

*Assistant Examiner*—Alexander S. Thomas

*Attorney, Agent, or Firm*—David M. Ostfeld

[57] ABSTRACT

A clipboard comprises a backing board, a clip mount attached to one end of the backing board, and a clip pivoted at the clip mount. The clip mount has an elevated portion indented with two spaced grooves each receiving an insert. These two inserts receive two coil springs which are sleeved and secured on both ends of the clip. Two holes are bored through the clip mount and backing board near the sideward free ends of the grooves. The free end of the coil spring extends through the hole and is stopped on the rear side of the backing board.

5 Claims, 6 Drawing Figures

CLIPBOARD

BACKGROUND OF THE INVENTION

This invention relates to a clipboard, particularly to one which obviates the use of rivets in assembly.

Rivets are required in conventional clipboard. A conventional clipboard as shown in FIG. 1 comprises a backing board 13, a clip mount 11 and a clip 10. The clip mount 11 is made of a metal sheet bent to form a cylindrical portion 12 to receive two ends of the clip 10. The clip mount 11 joins with the backing board 13 by means of two rivets 14 and 15.

SUMMARY OF THE INVENTION

This invention relates to a clipboard, particularly to one which obviates the use of rivets in assembly.

One object of the present invention is to provide a clipboard which obviates the use of rivets.

Another object of the present invention is to provide a clipboard wherein the backing board is integral with the clip mount, thus simplifying the process in making.

The present invention will be further described with reference to the accompanying drawings, the description being given by way of example only, not by way of limitation.

FIG. *3a, 3b, 3c* are perspective views showing the preferred embodiment of the present invention as the board and mount (FIG. *3c*), the clip mechanism (FIG. *3b*) and the inserts (FIG. *3a*)

Figure 1:
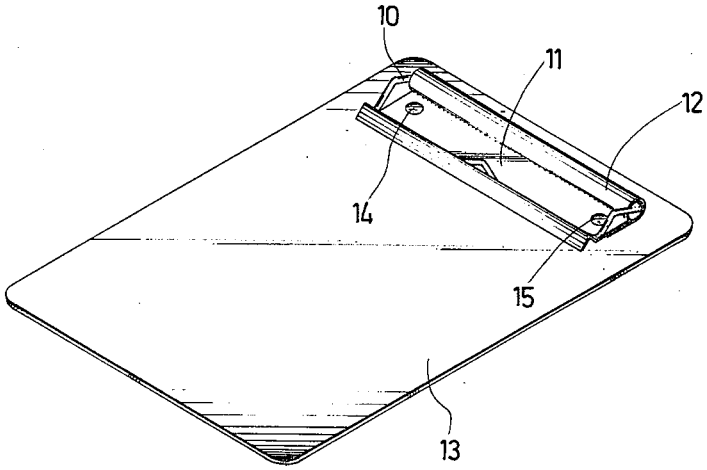
PRIOR ART FIG. 1
FIG. 1 is a perspective view of a conventional clipboard.
Figure 2:
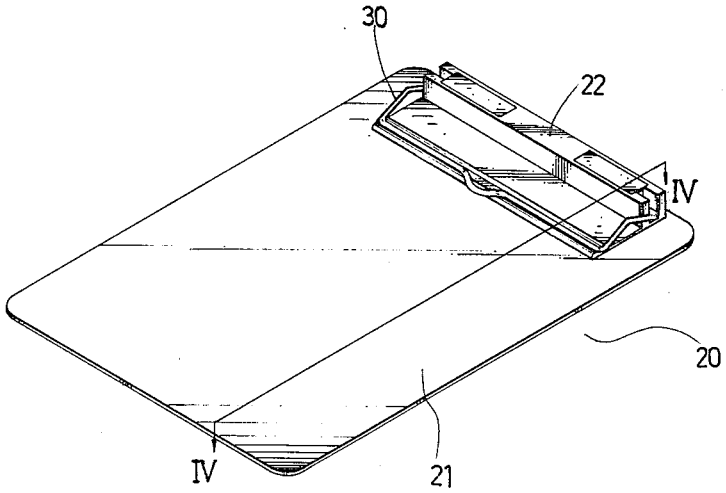
FIG. 2 is a perspective view of a preferred embodiment of the present invention.
Figure 4:
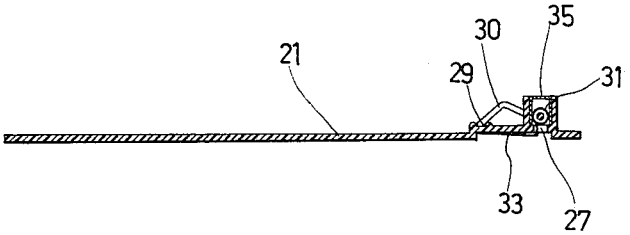

FIG. 4 is a longitudinally sectional view along line IV—IV as shown in FIG. 2.

DETAILED DESCRIPTION OF INVENTION

As shown in FIG. 2, a clipboard 20 of the present invention comprises a backing board 21, a clip mount 22 and a clip 30. The backing board 21 is preferably a rectangular board made by injection molding.

The clip mount 22 can be glued or high-frequency welded to the backing board 21. But the clip mount 22 is preferrable to be integral with the backing board 21 by molding them into one piece.

As shown in FIG. *3c*, the clip mount 22 is rectangular in shape having a central elevated portion 22' and end grooves 23, 24 on either side of elevated portion 22'. The outer, sideward free ends 25, 26 of grooves 23, 24 are, preferably, constricted. Two holes 27, 28 are bored through the bottoms of grooves 23, 24, respectively, near the sideward free ends 25, 26 and through backing board 21. Grooves 23, 24 are sized to receive inserts 35, 36.

Figure 3B:
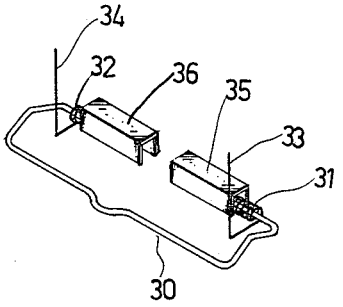
Figure 3A:
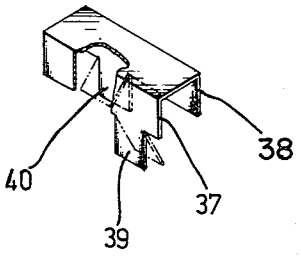
Figure 3C:
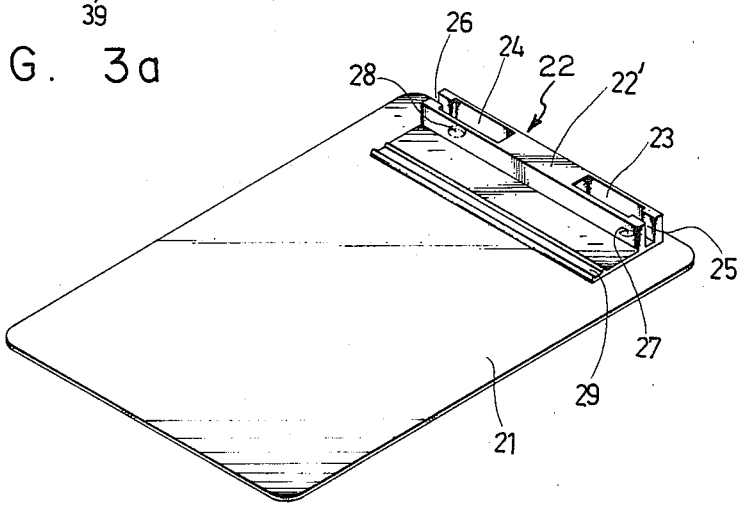

Two coil springs 31 and 32 are respectively sleeved and secured to two ends of the clip 30. The coil spring 31 has a free end 33 while the coil spring 32 has a free end 34. As shown in FIG. 3, two inserts are sleeved on the coil springs 31 and 32.

Each of the inserts 35, 36 has a set of two diagonally opposing tongues 39, 40 mounted on parallel sides 37, 38, respectively. Tongues 39, 40 are bent to a position where they are perpendicular to sides 37, 38 respectively. The inserts 35 and 36 are preferably made of malleable metal. In assembly, inserts 35, 36, with spring 31 inserted therein, are placed in grooves 23, 24 respectively. In assembly, the free ends 34 and 33 of the coil springs 32 and 31 extend respectively through the holes 28 and 27 and are stopped on the rear side of the backing board 21. Springs 31, 32 then hold inserts 35, 36 in place as seen in FIG. 4. FIG. 4 shows the position where the clipboard 20 of the present invention has been already assembled. To obtain a greater gripping effect, a groove 29 is provided at the front portion of the clip mount 22. In a normal position, the front edge of the clip 30 falls in the groove 29.

As many apparently widely different embodiments of this invention may be made without departing from the spirit and scope thereof, it is to be understood that the invention is not limited to the specific embodiments thereof as defined in the appended claims.

What I claim is:

1. A clipboard, comprising:

a backing board;

at least two inserts;

a clip mount attached to one end of said backing board, said clip mount having an elevated portion and two grooves, said grooves located on each side of said elevated portion and said inserts being inserted in said grooves;

a clip said clip mount and said backing board having two sets of adjacent openings therethrough;

two coil springs extending through said openings and being stopped at the rear side of said backing board, said clip being telescopically received in and attached to said springs and each of said springs being telescopically received in one of said inserts.

2. A clipboard as claimed in claim 1 wherein said backing board and said clip mount are integral with each other by molding them into one piece.

3. A clipboard as claimed in claim 1 or 2 wherein said grooves contract at the end of said grooves fartherest from said elevated portion.

4. A clipboard as claimed in claims 1, or 2 wherein said two holes are bored through said clip mount and said backing near the ends of said grooves farthest from said elevated portion.

5. A clipboard as claimed in claim 1, or 2, wherein each of said inserts has two opposing, spaced apart sides, each of said sides having a tongue extending therefrom and said tongues being diagonally opposite to each other and perpendicular to the opposing side.

* * * * *